US008328305B2

(12) United States Patent
Sakurai

(10) Patent No.: US 8,328,305 B2
(45) Date of Patent: Dec. 11, 2012

(54) LIQUID EJECTING APPARATUS

(75) Inventor: Hisaki Sakurai, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 274 days.

(21) Appl. No.: 12/715,371

(22) Filed: Mar. 1, 2010

(65) Prior Publication Data

US 2011/0001772 A1 Jan. 6, 2011

(30) Foreign Application Priority Data

Mar. 2, 2009 (JP) ..... 2009-047485

(51) Int. Cl.
*B41J 2/195* (2006.01)
*B41J 29/38* (2006.01)
*B41J 2/175* (2006.01)

(52) U.S. Cl. ..... 347/7; 347/14; 347/17; 347/85

(58) Field of Classification Search ..... None
See application file for complete search history.

(56) References Cited

U.S. PATENT DOCUMENTS 6,626,510 B2 * 9/2003 Maeda ..... 347/7
6,796,627 B2 * 9/2004 Kimura et al. ..... 347/7
2006/0033789 A1 2/2006 Sasaki et al.
2008/0204488 A1 * 8/2008 Usui ..... 347/7

FOREIGN PATENT DOCUMENTS

JP 2000-103082 A 4/2000
JP 2002-127454 A 5/2002
JP 2004-209669 A 7/2004
JP 2005-262564 A 9/2005
JP 2007-015254 A 1/2007

* cited by examiner

*Primary Examiner* — Stephen Meier
*Assistant Examiner* — Alexander C Witkowski
(74) *Attorney, Agent, or Firm* — Baker Botts L.L.P.

(57) ABSTRACT

A liquid ejecting apparatus includes a detector configured to be in a first state when an amount of liquid stored in a liquid container is greater than a first threshold amount, and to be in a second state when the amount of liquid is less than or equal to the first threshold amount, an estimator configured to estimate the amount of liquid, and a determiner configured to determine that, if it is determined that the state of the detector has changed from the first state to the second state, the liquid container has become a low-amount state, and that, if it is determined that the amount of liquid estimated by the estimator has become less than or equal to the second threshold amount, which is less than the first threshold amount, the liquid container has become the low-amount state.

5 Claims, 8 Drawing Sheets

LIQUID EJECTING APPARATUS

CROSS REFERENCE TO RELATED APPLICATION

The present application claims priority to and the benefit of Japanese Patent Application No. 2009-047485, which was filed on Mar. 2, 2009, the disclosure of which is incorporated herein by reference in its entirety.

BACKGROUND OF THE INVENTION

1. Field of the Invention

The present invention relates to liquid ejecting apparatus comprising a determiner configured to determine that a liquid container has become a low-amount state, in which an amount of liquid stored in the liquid container is low.

2. Description of Related Art

A known liquid ejecting apparatus, e.g., an inkjet printer, has a liquid ejecting head, e.g., an inkjet head, a liquid container, e.g., an ink cartridge configured to supply liquid to the liquid ejecting head, and a determiner configured to determine the amount of liquid stored in the liquid container.

The determiner of the known liquid ejecting apparatus may determine the amount of liquid with a sensor directly detecting the amount of liquid or with an estimator estimating the amount of liquid based on an amount of liquid consumed by the liquid ejecting head. For example, a known inkjet printer such as described in JP-A-2005-262564 has an ink cartridge configured to be removably mounted to a holder, and an optical sensor configured to detect the amount of ink stored in the ink cartridge. The ink cartridge has a float configured to move according to the amount of ink stored in the ink cartridge, and a light blocking plate connected to the float via an arm. The sensor is configured to detect whether or not the amount of ink is greater than or equal to a predetermined amount based on whether or not light emitted by the sensor is blocked by the light blocking plate. In addition, a controller of this known inkjet printer is configured to estimate the amount of ink stored in the ink cartridge based on an amount of ink consumed by the inkjet head.

The amount of ink estimated by the controller generally may be less accurate compared to the amount of ink detected by the sensor. Therefore, in the above-described known inkjet printer, the sensor detects whether or not the amount of ink is greater than or equal to a predetermined amount. Subsequently, after it is detected that the amount of ink reaches the predetermined amount, the controller estimates the amount of ink until the ink cartridge becomes empty.

Nevertheless, when the sensor is broken, or, when the float and/or the light blocking plate fails to move because they are assembled wrongly or they are manufactured defectively, the sensor may fail to detect the amount of ink stored in the ink cartridge. In such a case, the inkjet head may continue to eject ink even after the amount of ink stored in the ink cartridge becomes considerably low, which may end up with ink-ejecting failure because air may enter the inkjet head.

SUMMARY OF THE INVENTION

Therefore, a need has arisen for liquid ejecting apparatus which overcomes these and other shortcomings of the related art. A technical advantage of the present invention is that a liquid ejecting apparatus may be able to determine that a liquid container has become a low-amount state, in which an amount of liquid stored in the liquid container is low, even when a detector fail to detect an amount of ink stored in the liquid cartridge.

According to an embodiment of the present invention, a liquid ejecting apparatus comprises a liquid ejecting head configured to eject liquid, a liquid container configured to store liquid therein, and configured to be in fluid communication with the liquid ejecting head, a detector configured to detect an amount of liquid stored in the liquid container. The detector is configured to be in a first state when the amount of liquid stored in the liquid container is greater than a first threshold amount, and to be in a second state when the amount of liquid stored in the liquid container is less than or equal to the first threshold amount. The liquid ejecting apparatus also comprises an estimator configured to estimate the amount of liquid stored in the liquid container based on an amount of liquid consumed by the liquid ejecting head and a determiner configured to determine (a) whether a state of the detector has changed from the first state to the second state, (h) whether an amount of liquid estimated by the estimator has become less than or equal to a second threshold amount, which is less than the first threshold amount, (c) that, if it is determined that the state of the detector has changed from the first state to the second state, the liquid container has become a low-amount state, in which the amount of liquid stored in the liquid container is low, and (d) that, if it is not determined that the state of the detector has changed from the first state to the second state, but it is determined that the amount of liquid estimated by the estimator has become less than or equal to the second threshold amount, the liquid container has become the low-amount state.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Embodiments of the present invention, and their features and advantages, may be understood by referring to FIGS. 1-8, like numerals being used for like corresponding parts in the various drawings.

Figure 1:
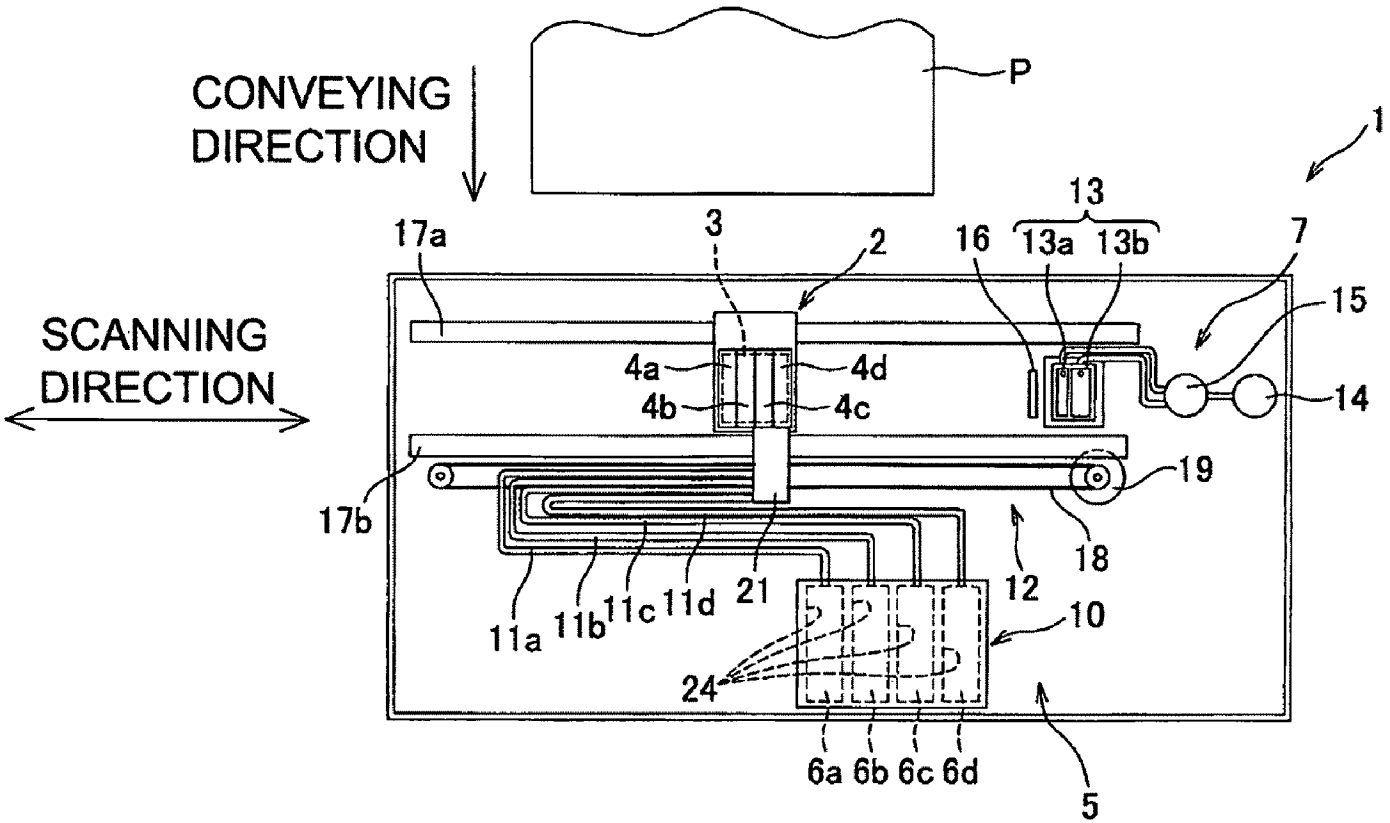
FIG. 1 is a schematic plan view of a printer according to an embodiment of the present invention.

Referring to FIG. 1, a liquid ejecting apparatus, e.g., a printer 1, comprises a carriage 2 configured to reciprocate in a scanning direction, e.g., the right-left direction in FIG. 1, a liquid ejecting head, e.g., an inkjet head 3 mounted on carriage 2, at least one, e.g., four, sub-tanks 4*a*-4*d* also mounted on carriage 2, an ink supply device 5 comprising at least one, e.g., four, liquid containers, e.g., ink cartridges 6*a*-6*d*, a maintenance mechanism 7, and a controller 8 (see FIG. 6) configured to control components of printer 1. Maintenance mechanism 7 is configured to recover ink-ejecting performance of inkjet head 3 when the performance has deteriorated due to air entering to inkjet head 3, thickened ink in inkjet head 3, etc.

Printer 1 comprises a two guide shafts 17*a*, 17*b* extending in the scanning direction, and two guide shafts 17*a*, 17*b* are separated in a conveying direction which is perpendicular to the scanning direction. Carriage 2 is configured to reciprocate along two guide shafts 17*a*, 17*b* in the scanning direction, being driven by a drive mechanism 12 of printer 1. Drive mechanism 12 comprises an endless belt 18 coupled to carriage 2, and a carriage drive motor 19 coupled to endless belt 18. Carriage drive motor 19 is configured to drive endless belt 18. Carriage 2 moves in the scanning direction when endless belt 18 runs.

Figure 2:
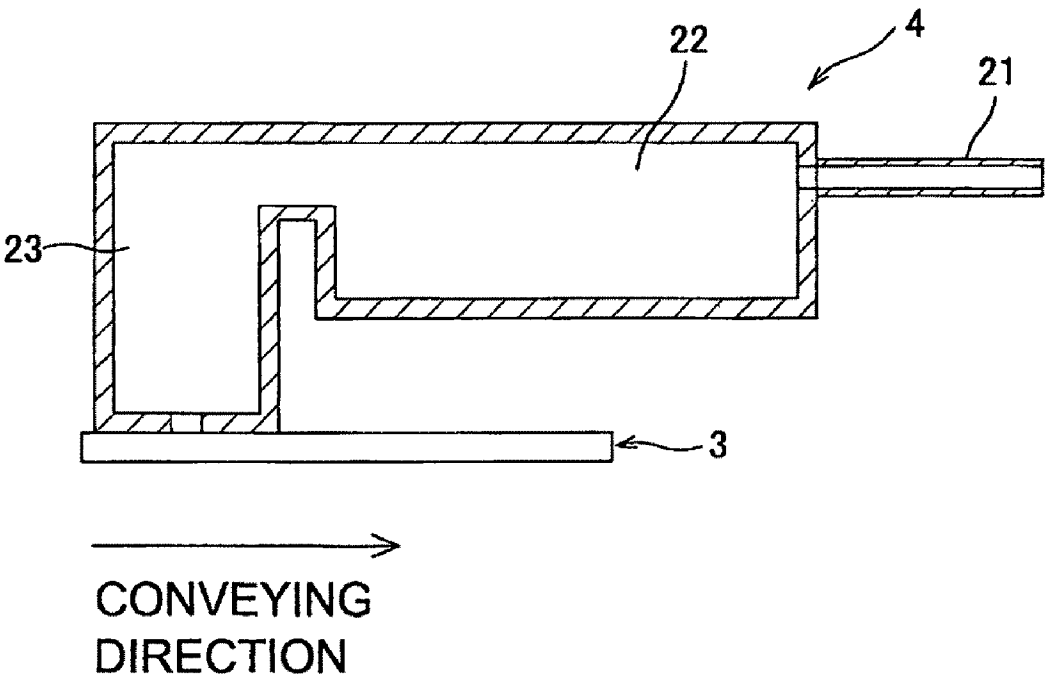
FIG. 2 is a side cross-sectional view of a sub-tank and an inkjet head according to an embodiment of the present invention.
Figure 3:
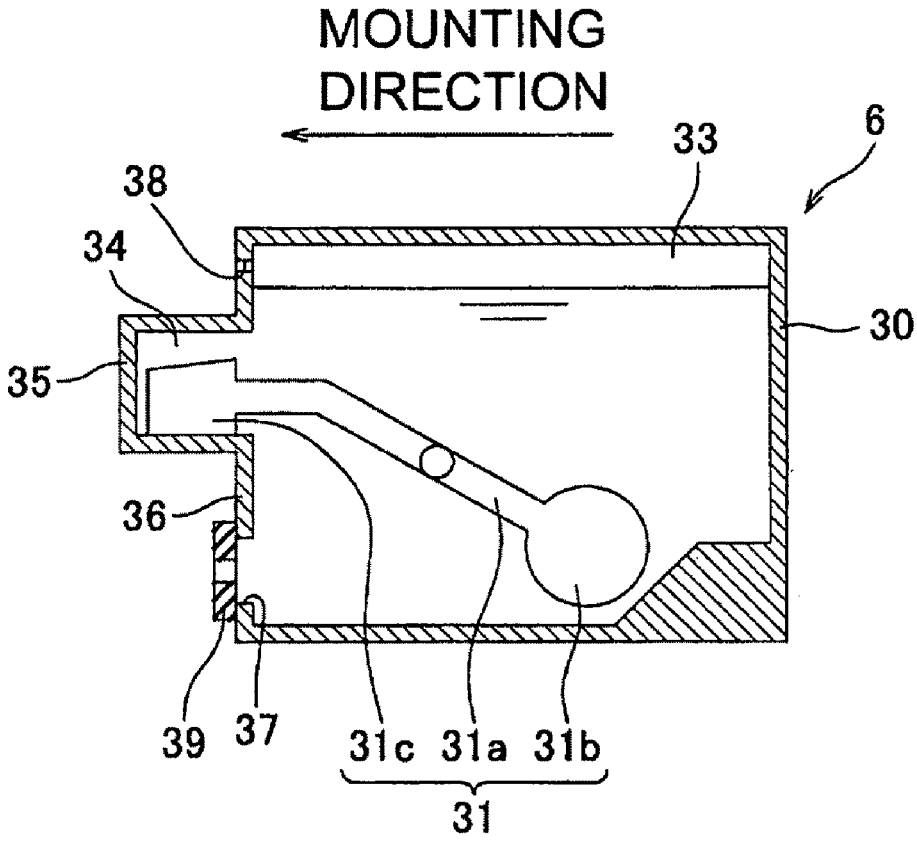
FIG. 3 is a side cross-sectional view of an ink cartridge according to an embodiment of the present invention.
Figure 4:
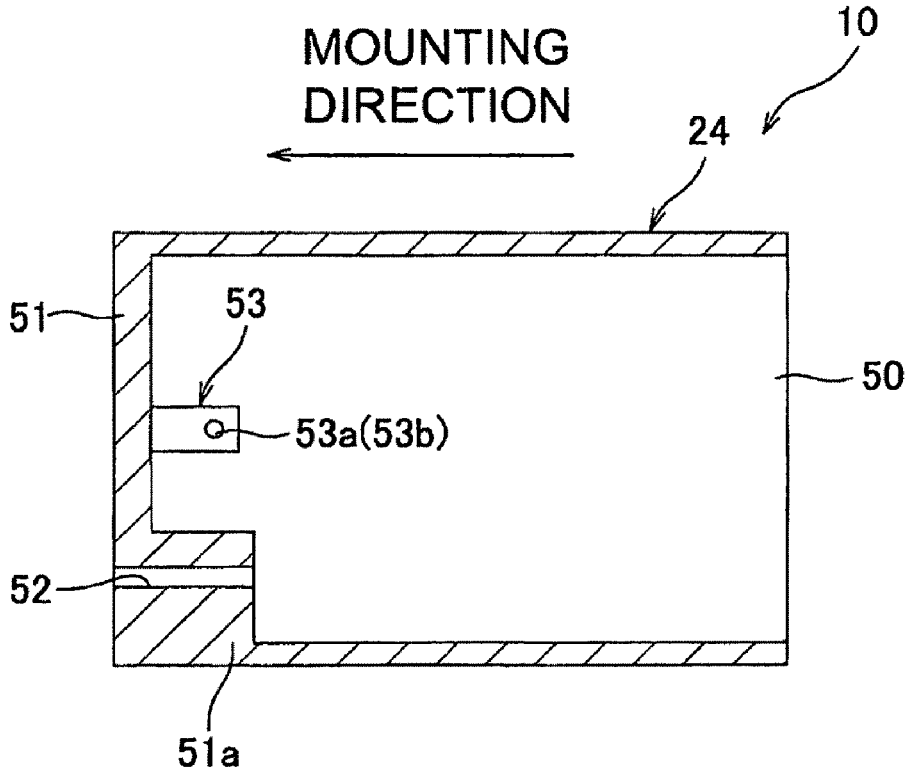
FIG. 4 is a side cross-sectional view of a cartridge mounting portion according to an embodiment of the present invention.

Referring to FIGS. 1 and 2, four sub-tanks 4*a*-4*d* are aligned in the scanning direction. Inkjet head 3 is positioned at lower ends of sub-tanks 4*a*-4*d*. Each sub-tank 4 comprises an ink chamber 22 formed therein and a communication path 23 formed therein. Communication path 23 is in fluid communication with ink chamber 22 and extends in the gravitational direction. A tube joint 21 is integrally attached to ends of sub-tanks 4*a*-4*d*. Ink chambers 22 of sub-tanks 4*a*-4*d* are in fluid communication with ink supply device 5 via flexible tubes 11*a*-11*d* attached to tube joint 21, respectively. Lower ends of communication paths 23 of sub-tanks 4*a*-4*d* are connected to ink supply openings formed in the upper surface of inkjet head 3, respectively. Consequently, ink is supplied from ink supply device 5 via fixable tube 11 to ink chamber 22 and stored temporally in ink chamber 22. Subsequently, ink stored in ink chamber 22 is supplied to inkjet head 3 via communication path 23.

Inkjet head 3 comprises ink-ejection nozzles formed in its lower surface, e.g., on a reverse side of the sheet of FIG. 1. While reciprocating with carriage 2 in the scanning direction, inkjet head 3 ejects ink, which is supplied from sub-tanks 4*a*-4*d*, through the ink-ejection nozzles onto a recording sheet P being conveyed in the conveying direction by a conveying mechanism 9 (see FIG. 6) comprising a sheet feed roller and a sheet discharge roller, such that desired texts or images are recorded on recording sheet P.

Ink supply device 5 comprises four ink cartridges 6*a*-6*d* storing a black ink, a cyan ink, a magenta ink, and a yellow ink, respectively, and a holder 10 comprising four cartridge mounting portions 24 to which four ink cartridges 6*a*-6*d* are removably mounted, respectively. Four color inks stored in ink cartridges 6*a*-6*d* are supplied to sub-tanks 4*a*-4*d* via flexible tubes 11*a*-11*d* coupled to holder 10, respectively.

Maintenance mechanism 7 is positioned at a maintenance position which is located in a movable range of carriage 2 and which is located outside a printing area where carriage 2 faces recording sheet P and inkjet had 3 performs printing. Maintenance mechanism 7 comprises a capping member 13 configured to hermetically contact the lower surface of inkjet head 3 where ink-ejection nozzles are formed, suction pump 14 connected to capping member 13, and a wiper 16 configured to wipe out ink adhering to the lower surface of inkjet head 3.

When carriage 2 moves to the maintenance position to recover ink-ejecting performance of inkjet head 3, capping member 13 faces the lower surface of inkjet head 3 where the ink-ejection nozzles are formed. Subsequently, capping member 13 is moved upward (forward in FIG. 1) by a drive mechanism (not shown), and hermetically contacts the lower surface of inkjet head 3, such that the ink-ejection nozzles are entirely covered.

Capping member 13 is coupled to suction pump 14 via a switching unit 15. When suction pump 14 is driven while the ink-ejection nozzles are covered by capping member 13, ink is sucked from the ink-ejection nozzles and drained. As such, dried or thickened ink in the ink-ejection nozzles or air staying in inkjet head 3 can be sucked and drained. This sucking and draining is called "suction purge". After the suction purge is performed, capping member 13 is moved down and separates from the lower surface of inkjet head 3. Subsequently, inkjet head 3 moves in the scanning direction relative to wiper 16, and ink adhering to the lower surface of inkjet head 3 is wiped out by wiper 16.

Capping member 13 comprises a first capping portion 13*a* configured to cover one group of the ink-ejecting nozzles through which the black ink is ejected, and a second capping portion 13*b* configured to cover the other group of the ink-ejecting nozzles through which three color inks other than the black ink are ejected. Switching unit 15 is configured to selectively connect one of first capping portion 13*a* and second capping portion 13*b* to suction pump 14, such that the suction purge for one group of the ink-ejecting nozzles and the suction purge for the other group of the ink-ejection nozzles are performed independently and separately.

Four ink cartridges 6*a*-6*d*, storing different color inks, have the same structure or similar structures. Therefore, referring to FIG. 3, one ink cartridge 6 is described in detail below. Unless otherwise specified, the front, rear, top and bottom of ink cartridge 6 may be defined in conjunction with an orientation in which ink cartridge 6 is mounted to cartridge mounting portion 24. Ink cartridge 6 is configured to be mounted to cartridge mounting portion 24 in a mounting direction, i.e., to the left in FIG. 3.

Ink cartridge 6 comprises a case 30 comprising an ink chamber 33 formed therein for storing ink. Case 30 comprises an ink supply opening 37 formed through a front wall 36 of case 30 for supplying ink from ink chamber 33 to the exterior of case 30. Ink cartridge 6 also comprises a sensor arm 31 positioned in ink chamber 33 for detecting the amount of ink stored in ink chamber 33.

Case 30 has a substantially rectangular parallelepiped shape and is made of a material through which light, e.g., visible or infrared light, can pass, such as translucent, e.g., transparent or semi-transparent, synthetic resin material. Case 30 comprises a protrusion 35 protruding forward from front wall 36. Protrusion 35 has a sensor chamber 34 formed therein, and sensor chamber 34 is in fluid communication with ink chamber 33. A light blocking plate 31*c* of sensor arm 31 is positioned in sensor chamber 34.

Ink supply opening 37 is formed through front wall 36 between protrusion 35 and the lower end of front wall 36. An annular sealing member 39 made of rubber is positioned at ink supply opening 37. An air introduction opening 38 is formed through front wall 36 between protrusion 35 and the upper end of front wall 36. Air is introduced from the exterior of case 30 into ink chamber 33 through air introduction opening 38.

Sensor arm 31 comprises an arm portion 31*a* pivotably supported by case 30 in ink chamber 33, a float 31*b* connected to one end of aim portion 31*a* and configured to move up and down according to the amount of ink stored in ink chamber 33, and light blocking plate 31*c* connected to the other end of arm portion 31*a*. Light blocking plate 31*c* is positioned in sensor chamber 34 of protrusion 35. When ink cartridge 6 is mounted in cartridge mounting portion 24 and light blocking plate 31*c* is in a lower limit position where light blocking plate 31 contacts the bottom surface of sensor chamber 34, light blocking plate 31*c* blocks light emitted from an optical sensor 53 positioned in cartridge mounting portion 24.

When float 31*b* moves up and down according to the amount of ink stored in ink chamber 33, light blocking plate 31*c* coupled to float 31*b* via arm portion 31*a* moves up and down in sensor chamber 34 relative to case 30. More specifically, when ink chamber 33 has a sufficient amount of ink stored therein, float 31*b* is submerged in ink. Because a relatively large buoyancy acts on float 31*b*, a moment acts on arm portion 31*a* in the counterclockwise direction in FIG. 3, and light blocking plate 31*c* contacts the bottom surface of sensor chamber 34. On the other hand, when the amount of ink stored in ink chamber 33 decreases and a portion of float 31*b* is exposed from the ink surface, the buoyancy becomes smaller. When the amount of ink further decreases, arm portion 31*a* pivots in the clockwise direction in FIG. 3, and float 31*b* contacts the bottom surface of ink chamber 33 and light blocking plate 31*c* contacts the top surface of sensor chamber 34.

Referring to FIG. 1, holder 10 comprises four cartridge mounting portions 24 aligned in the scanning direction. Four ink cartridge mounting portions 24 have the same structure or similar structures. Therefore, referring to FIG. 4, one ink cartridge mounting portion 24 is described in detail below.

Cartridge mounting portion 24 comprises a cartridge accommodating chamber 50 formed therein, and cartridge accommodating chamber 50 is exposed rearward via an opening. Cartridge mounting portion 24 comprises a front wall 51 positioned opposite the opening of cartridge mounting portion 24, an ink supply path 52 formed through front wall 51, and optical sensor 53 positioned at front wall 51.

Ink cartridge 6 is inserted into cartridge accommodating chamber 50 via the opening of cartridge mounting portion 24. A lower portion of front wall 51 comprises a protruding portion 51*a* protruding rearward further than an upper portion of front wall 51. Ink supply path 52 is formed through protruding portion 51*a*. Ink supply path 52 is in fluid communication with inkjet head 3 via flexible tube 11 (see FIG. 1). Optical sensor 53 is positioned at a middle portion of front wall 51 with respect to the gravitational direction. Optical sensor 53 comprises a light emitting portion 53*a* and a light receiving portion 53*b* aligned in a horizontal direction (in a direction perpendicular to the sheet of FIG. 4) with a gap formed therebetween, and light emitting portion 53*a* is configured to emit light, e.g., visible or infrared light, toward light receiving portion 53*b*.

Optical sensor 53 is an example of the detector and is configured to detect the amount of ink stored in ink cartridge 6, more specifically, detect whether the amount of ink stored in ink cartridge 6 is greater than a first threshold amount, based on the position of light blocking plate 31*c*.

Figure 5A:
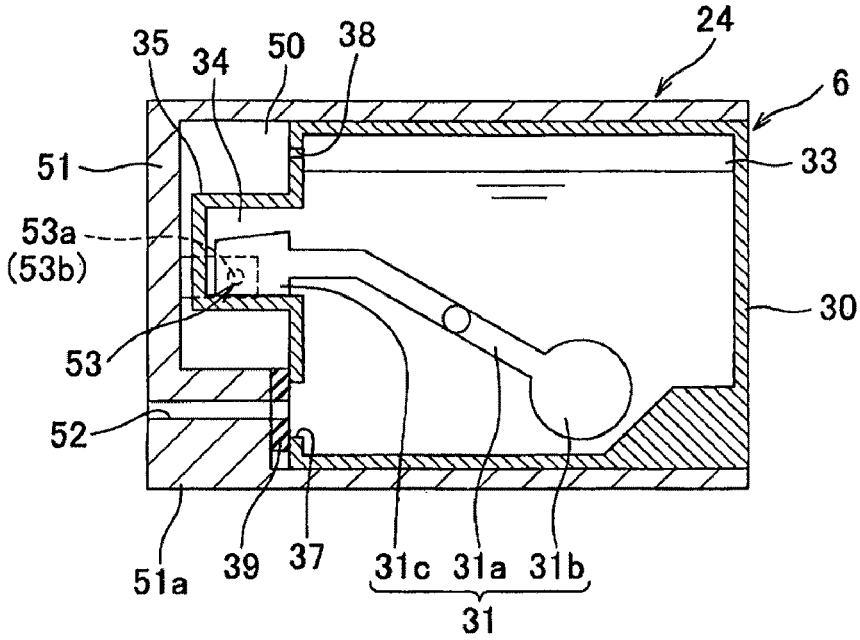
FIG. 5A and FIG. 5B are side cross-sectional views of the ink cartridge of FIG. 3 mounted in the cartridge mounting portion of FIG. 4, in which an amount of ink stored in the ink cartridge is relatively high in FIG. 5A and the mount of ink stored in the ink cartridge is relatively low in FIG. 5B.
Figure 5B:
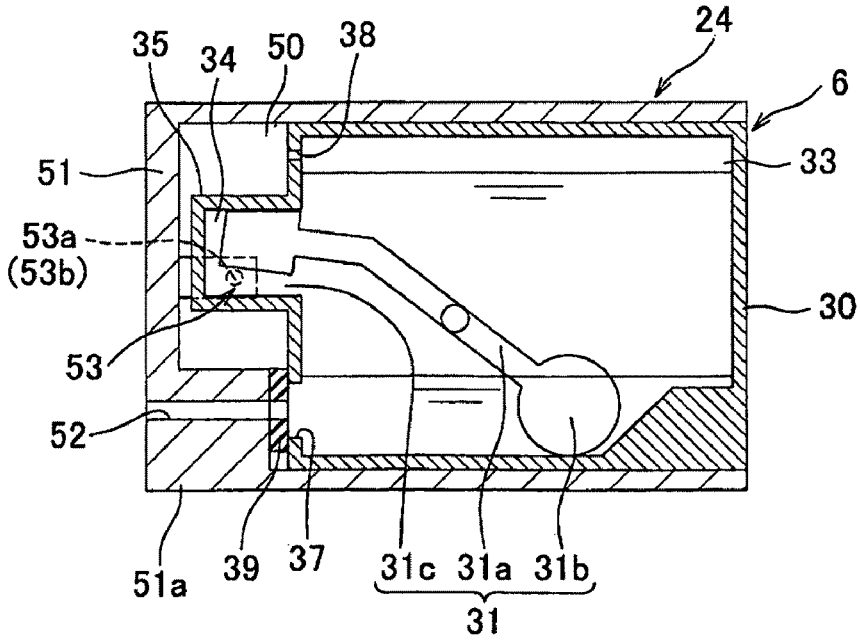

Referring to FIGS. 5A and 5B, when ink cartridge 6 is inserted into cartridge accommodating chamber 50, sealing member 39 contacts protruding portion 51*a*, such that ink supply path 52 formed in protruding portion 51*a* communicates with ink supply opening 37 formed through front wall 36 of case 30. By the time when this occurs, air introduction opening 38 has been opened, and consequently, air is introduced from air introduction opening 38 into ink chamber 33, and ink is supplied from ink chamber 33 via ink supply opening 37 to ink supply path 52.

When ink cartridge 6 is inserted into cartridge accommodating chamber 50, protrusion 35 is positioned between light emitting portion 53*a* and light receiving portion 53*b*. When the amount of ink stored in ink cartridge 6 is greater than the first threshold amount, light blocking portion 31*c* is in the lower limit position where light blocking plate 31 contacts the bottom surface of sensor chamber 34, as in FIG. 5A, and light blocking portion 31*c* blocks the light emitted by light emitting portion 53*a*. Therefore, light receiving portion 53*b* does not receive the light. When light receiving portion 53*b* does not receive the light, optical sensor 53 is in an ON state in which optical sensor 53 outputs an ON signal, e.g., a high voltage signal, to controller 8. When receiving the ON signal from optical sensor 53, controller 8 determines that ink cartridge 6 is in a high-amount state, in which the amount of ink stored in ink cartridge 6 is high.

On the other hand, when the amount of ink stored in ink cartridge 6 decreases and becomes less than or equal to the first threshold amount, light blocking plate 31 moves up and contacts the top surface of sensor chamber 34, and light blocking plate 31 no longer blocks the light emitted by light emitting portion 53*a*. Therefore, the light passes through protrusion 35 and is received by light receiving portion 53*b*. When light receiving portion 53*b* receives the light, optical sensor 53 is in an OFF state in which optical sensor 53 outputs OFF signal, e.g., a low voltage signal, to controller 8. When receiving the OFF signal from optical sensor 53, controller 8 determines that ink cartridge 6 is in a low-amount state, in which the amount of ink stored in ink cartridge 6 is low.

Moreover, when ink cartridge 6 is inserted into cartridge accommodating chamber 50, the state of optical sensor 53 changes from the OFF state to the ON state. When controller 8 determines that the state of optical sensor 53 has changed from the OFF state to the ON state, controller 8 determines that new ink cartridge 6 has been mounted to cartridge mounting portion 24.

Figure 6:
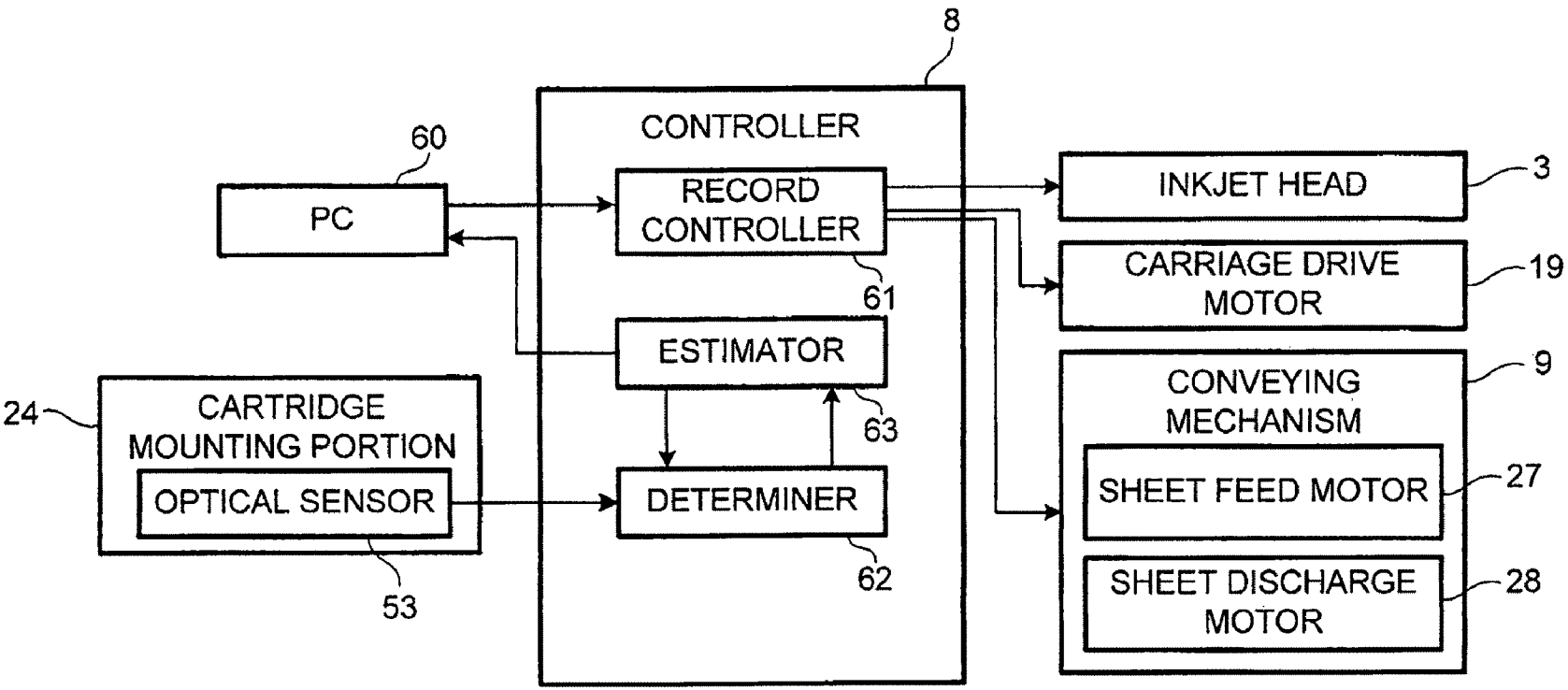
FIG. 6 is a block diagram of an electric configuration of the printer of FIG. 1.

Referring to FIG. 6, controller 8 comprises a Central Processing Unit (CPU), a Read-Only Memory (ROM) storing various programs and data, and a Random Access Memory (RAM) as a storage area or a working area for storing various data temporarily when the CPU executes the programs stored in the ROM. Controller 8 may comprise hardware comprising various circuits comprising arithmetic circuits.

When receiving date, which relate to texts or images to be recoded, from a personal computer (PC), a record controller 61 of controller 8 is configured to control inkjet head 3, carriage drive motor 19, and a sheet feed motor 27 and a sheet discharge motor 28 which drives the sheet feed roller and the sheet discharge roller of conveying mechanism 9, respectively, to record texts or images on recording sheet P.

Controller 8 comprises a determiner 62 configured to determine whether ink cartridge 6 is in the low-amount state, in which the amount of ink stored in ink cartridge 6 is low, based on a detection result of optical sensor 53, and an estimator 63 configured to estimate the amount of ink stored in ink cartridge 6 based on an amount of ink consumed by inkjet head 3.

When determiner 62 determines that the state of optical sensor 53 has changed from the OFF state to the ON state, determiner 62 determines that new ink cartridge 6 has been mounted to cartridge mounting portion 24. Determiner 62 determines that ink cartridge 6 is in the high-amount state, in which the amount of ink stored in ink cartridge 6 is high, as long as optical sensor 53 is in the ON state. When determiner 62 determines that the state of optical sensor 53 has changed from the ON state to the OFF state, determiner 62 determines that ink cartridge 6 has become the low-amount state, in which the amount of ink stored in ink cartridge 6 is low.

When determiner 62 determines that that new ink cartridge 6 has been mounted to cartridge mounting portion 24, estimator 63 starts to estimate the amount of ink stored in ink cartridge 6 by subtracting the amount of ink consumed by inkjet head 3 after determiner 62 determines that that new ink cartridge 6 has been mounted to cartridge mounting portion 24 from an initial amount of ink stored in new ink cartridge 6, which is stored in ROM in advance. The amount of ink consumed by inkjet head 3 comprises the amount of ink consumed when inkjet head 3 ejects ink onto recording sheet P, the amount of ink sucked and drained during the suction purge, and the amount of ink ejected from inkjet head 3 when inkjet head 3 is flushed, which is so called "flushing". The flushing is performed when inkjet head 3 ejects ink onto recording sheet P and before and after inkjet head 3 ejects ink onto recording sheet P. More specifically, estimator 63 estimates the amount of ink consumed by inkjet head 3, by counting the number of ink droplets ejected when inkjet head 3 ejects ink onto recording sheet P, the number of times the suction purge is performed, and the number of times inkjet head 3 is flushed, and by referring to values such as the volume of each ink droplet, the amount of ink drained per suction purge, and the amount of ink needed per flushing, which are stored in ROM in advance.

The amount of ink estimated by estimator 63 is an amount of ink indirectly obtained, and generally less accurate compared to direct detection of the ink amount. Therefore, whether ink cartridge 6 is in the low-amount state is determined based on the detection by optical sensor 53. The estimation by estimator 63 is used for displaying indication of the ink amount on a display of PC 60

If optical sensor 53 is broken, or, when sensor arm 31 fails to move because case 30 and sensor arm 31 are assembled wrongly or they are manufactured defectively, optical sensor 53 may fail to detect the amount of ink stored in ink cartridge 6. In such a case, because determiner 62 may not be able to determine that ink cartridge 6 is in the low-amount state, inkjet head 3 may continue to eject ink even after the amount of ink stored in ink cartridge 6 becomes considerably low, which may end up with ink-ejecting failure because air may enter inkjet head 3. To recover inkjet head 3 experiencing the ink-ejecting failure, the suction purge by maintenance mechanism 7 may need to be performed many times, and a considerable amount of ink may be wasted.

In this embodiment, however, when optical sensor 53 fails to detect the amount of ink stored in ink cartridge 6, determiner 62 determines whether ink cartridge 6 is in the low-amount state based on the amount of ink estimated by estimator 63. Nevertheless, it may not be preferable that the low-amount state is determined based on the less accurate estimation by estimator 63 before the low-amount state is determined based on the more accurate detection by optical sensor 53. Therefore, threshold ink amounts used for the determination of the low-amount state need to be set, such that the determination based on the detection by optical sensor 53 is prioritized over the determination based on the estimation by estimator 63.

Figure 7:
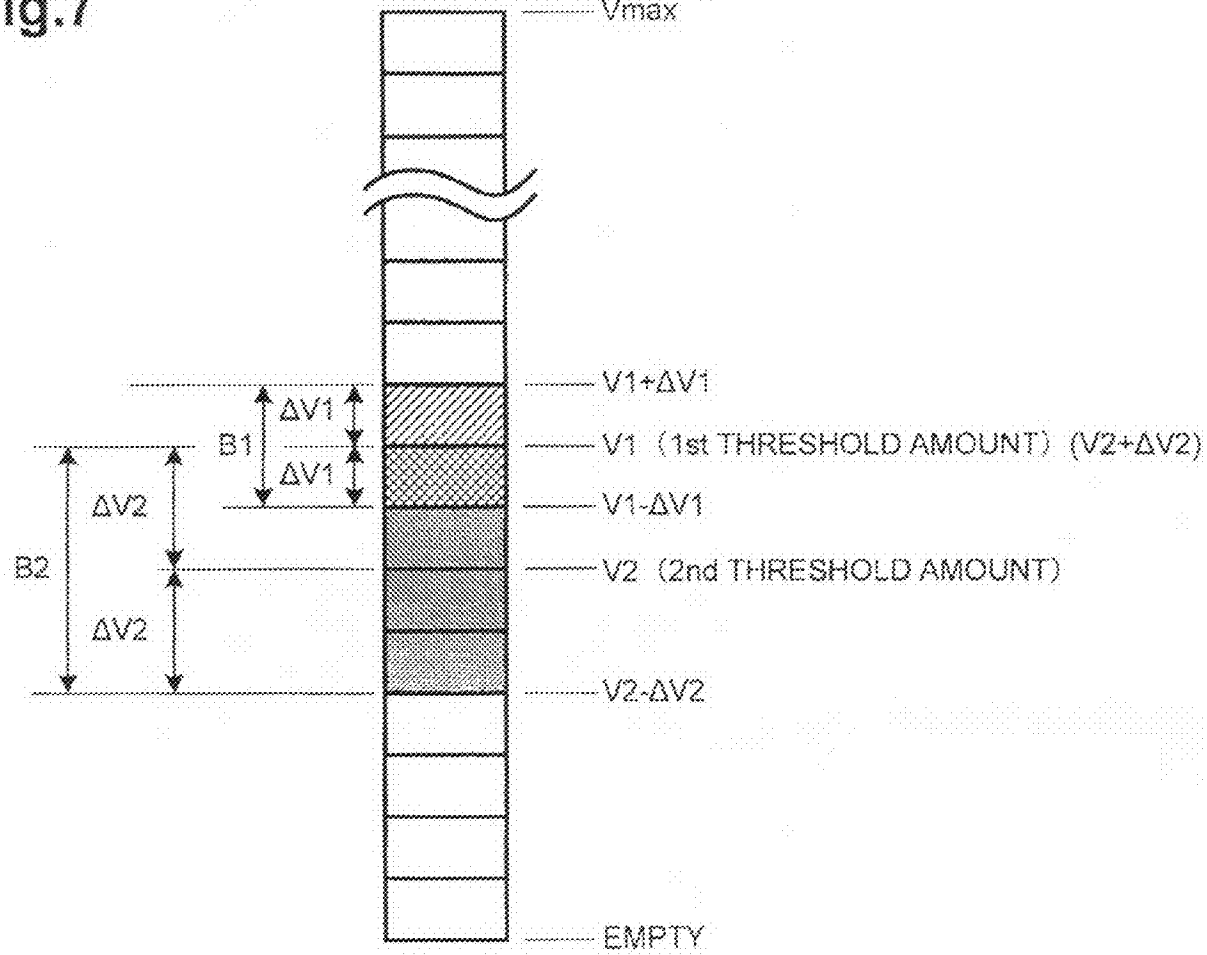
FIG. 7 is a diagram illustrating relationship between threshold amounts according to an embodiment of the present invention.

Referring to FIG. 7, "Vmax" stands for an initial amount of ink stored in new ink cartridge 6, and "empty" stands for zero amount of ink. "V1" stands for the first threshold amount used for the determination of the low-amount state based on the detection by optical sensor 53. In other words, when the amount of ink stored in ink cartridge 6 is greater than first threshold amount V1, optical sensor 53 is in the ON state, and therefore determiner 62 determines that ink cartridge 6 is in the high-amount state. When the amount of ink stored in ink cartridge 6 is less than or equal to first threshold amount V1, optical sensor 53 is in the OFF state, and therefore determiner 62 determines that ink cartridge 6 is in the low-amount state. "V2" stands for a second threshold amount used for the determination of the low-amount state based on the estimation by optical estimator 63. In other words, when the amount of ink estimated by estimator 63 is less than or equal to second threshold amount V2, determiner 62 determines that ink cartridge 6 is in the low-amount state. Second threshold amount V2 is less than first threshold amount V1. Consequently, as long as optical sensor 53 detects the amount of ink correctly, the low-amount state is determined based on the detection by optical sensor 53. If optical sensor 53 fails to detect the amount of ink, and when the actual amount of ink becomes less than first threshold amount V1, the low-amount state is determined based on the estimation by estimator 63.

As described above, even if optical sensor 53 fails to detect the amount of ink, the low-amount state can be determined. Therefore, inkjet head 3 may be prevented from continuing to eject ink even after the amount of ink stored in ink cartridge 6 becomes considerably low. The ink-ejecting failure may be prevented.

The amount of ink detected by optical sensor 53 and the amount of ink estimated by estimator 63 may include errors. For example, the amount of ink stored in ink cartridge 6 when light blocking late 31*c* moves out of the light path of optical sensor 53 may vary from first threshold amount V1 because of errors in positioning optical sensor 53 in cartridge mounting portion 24, dimension errors of sensor arm 31, and errors in positioning sensor arm 31 in case 30. The amount of ink estimated by estimator 63 may vary from the actual amount of ink because actual volumes of ink droplets, actual amount of ink sucked and drained during the suction purge, etc. may differ from expected values.

Moreover, the estimation by estimator 63 is generally less accurate than the detection of optical sensor 53. In other words, an estimation error ΔV2 corresponding to a differential between the amount of ink estimated by estimator 63 and the actual amount of ink is greater than an detection error ΔV1 corresponding to a differential between the amount of ink detected by optical sensor 63 and the actual amount of ink.

Consequently, even when the actual amount of ink is greater than first threshold amount V1 and therefore the low-amount state is not determined based on the detection by optical sensor 53, the amount of ink estimated by estimator 63 may become less than second threshold amount V2 due to estimation error ΔV2 and the low-amount state is determined based on the estimation at very early stage. Therefore, it may be needed to set second threshold amount V2, such that the low-amount state is not determined based on the estimation by estimator 63 before the actual ink amount becomes less than or equal to first threshold amount V1.

Estimation error ΔV2 is stored in the ROM of controller 8 in advance. In this case, the ROM is an example of an error setter. In another embodiment, estimation error ΔV2 may be input from PC 60 for example. In this case, PC 60 may be an en error setter. Estimation error ΔV2 is determined empirically in designing printer 1.

Referring to FIG. 7, determiner 62 sets second threshold amount

V2, such that second threshold amount V2 plus estimation error ΔV2 becomes less than or equal to first threshold amount V1. Second threshold amount V2 plus estimation error ΔV2 corresponds to the upper limit of a range B2 within which the low-amount state can be determined based on the amount of ink estimated by estimator 63. Therefore, because the timing at which the low-amount state is determined based on the amount of ink estimated by estimator 63 is at the earliest when the actual amount of ink is first threshold amount V1, the low-amount state may not be determined based on the amount of ink estimated by estimator 63 when the actual amount of ink is greater than first threshold amount V1.

When the actual amount of ink becomes less than or equal to first threshold value V1, the low-amount state may not be determined based on the amount of ink detected by optical sensor 53 due to detection error ΔV1. In this case, the low-amount state may be determined based on the amount of ink estimated by estimator 63 before the low-amount state is determined based on the amount of ink detected by optical sensor 53. Nevertheless, it may be desirable that the low-amount state is determined as early as possible after the actual ink amount becomes less than or equal to first threshold amount V1, regardless of whether such determination is based on the amount of estimated by estimator 63 or on the amount of ink detected by optical sensor 53

Determiner 62 may set second threshold amount V2, such that second threshold amount V2 plus estimation error ΔV2 (the upper limit of range B2) becomes less than first threshold amount V1. Nevertheless, if second threshold amount V2 is considerably less than first threshold amount V1, when the low-amount state is determined based on the amount of ink estimated by estimator 63, the actual amount of ink may be considerably low. Therefore, it may be preferable the upper limit of range B2, i.e., V2 plus ΔV2 is close to V1, e.g., the upper limit of range B2, i.e., V2 plus ΔV2 is equal to V1

There may be a possibility that ink cartridge 6 has been empty when the low-amount state is determined based on the amount of ink estimated by estimator 63. Nevertheless, in this embodiment, even when ink cartridge 6 becomes empty, air may not enter inkjet head 3 right away because there are provided sub-tank 4, which temporally stores ink, and flexible tube 11 between inkjet head 3 and ink cartridge 6. Second threshold amount V2 may be set, taking into account the volume of sub-tank 4 and flexible tube 11.

If determiner 62 determines that ink cartridge 6 has become the low-amount state based on the detection by optical sensor 53, estimator 63 restarts to estimate the amount of ink stored in ink cartridge 6 after the low-amount state is determined, by subtracting the amount of ink consumed by inkjet head 3 after the low-amount state is determined from a first predetermined amount Ve1. On the other hand, if determiner 62 determines that ink cartridge 6 has become the low-amount state based on the estimation by estimator 63, estimator 63 restarts to estimate the amount of ink stored in ink cartridge 6 after the low-amount state is determined, by subtracting the amount of ink consumed by inkjet head 3 after the low-amount state is determined from a second predetermined amount Ve2. Second predetermined amount Ve2 may be less than first predetermined amount Ve1. Subsequently, when the estimated ink amount reaches some amount, e.g., zero, determiner 62 determines that ink cartridge 6 becomes empty. When this occurs, record controller 61 prevents inkjet head 3 from ejecting ink. Because estimator 63 restarts to estimate the ink amount, ink stored in ink cartridge 6 may be used up without any ink being left in ink cartridge 6.

Sensor arm 31 may not move when the ink amount becomes less than or equal to first threshold value V1, but may move when the ink amount becomes considerably less than first threshold value V1. This may happen when sensor arm 31 has been temporally adhering to an inner surface of ink chamber 33 and has not move, but suddenly moves when ink cartridge 6 is vibrated for some reason, or when a big bubble has exited below sensor arm 31 and sensor arm 31 has not move, but sensor arm 31 suddenly moves when the bubble burst. By the time when sensor arm 31 finally moves, the low-amount state may have been determined based on the estimation by estimator 63. Nevertheless, even if the state of optical sensor 53 changes from the ON state to the OFF state after determiner 62 determines that ink cartridge 6 has become the low-amount state based on the estimation by estimator 63, estimator does not reset the estimated amount of ink in ink cartridge 6 after the low-amount state is determined.

As mentioned above, second predetermined amount Ve2 may be less than first predetermined amount Ve1 because second threshold value V2 is less than first threshold value V1. First predetermined amount Ve1 may be set to equal to the lower limit of a range B1 within which the low-amount state can be determined based on the amount of ink detected by optical sensor 53, i.e., equal to V1 minus ΔV1. Second predetermined amount Ve2 may be set to equal to the lower limit of range B2, i.e., equal to V2 minus ΔV2.

Figure 8:
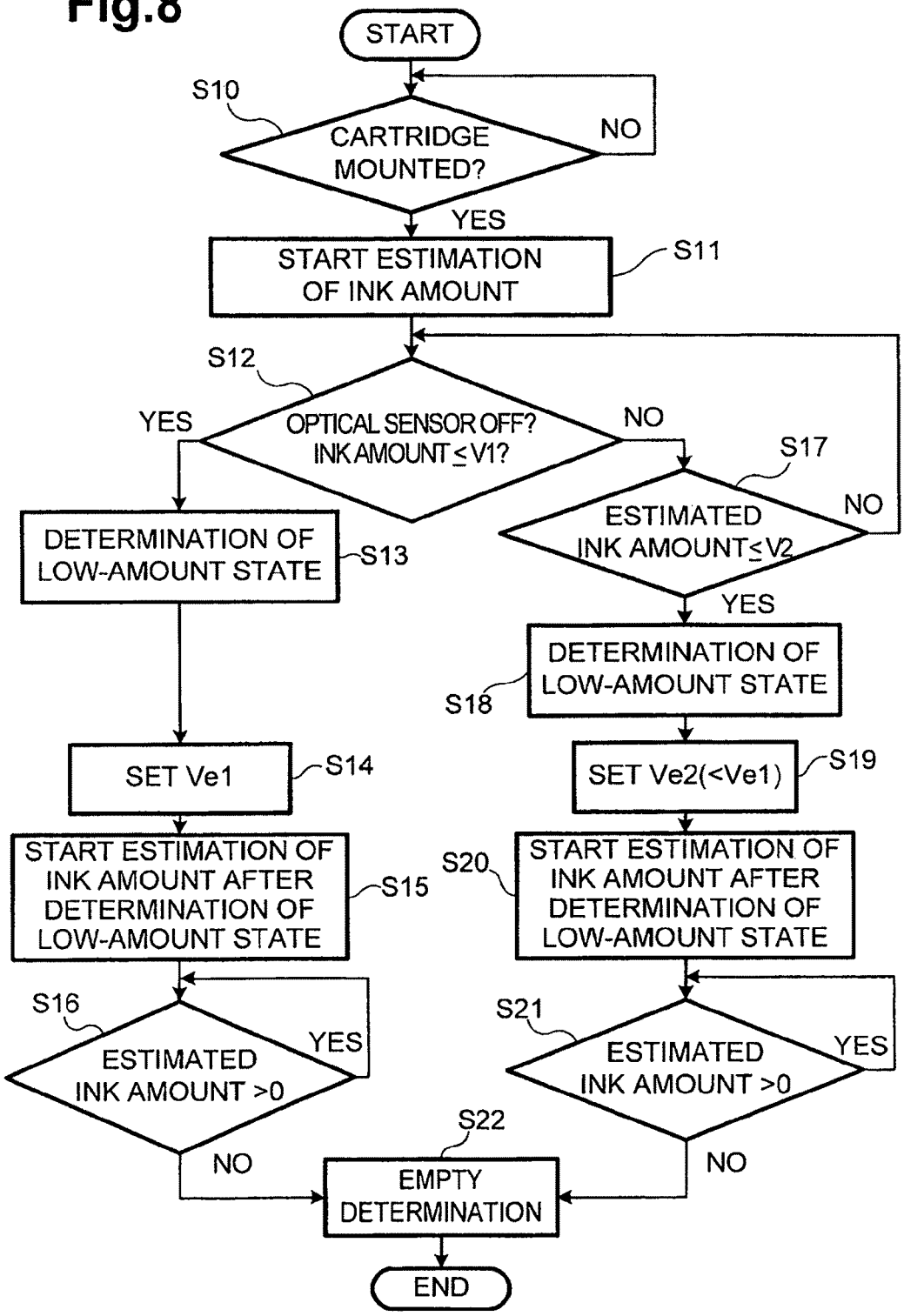
FIG. 8 is a flowchart of a determination procedure according to an embodiment of the present invention.

The above-described procedure to determine the low-amount state of ink cartridge 6 is represented in FIG. 8. In FIG. 8, Si (i=10, 11, 12. . . ) means a step number.

If determiner 62 determines that the state of optical sensor 53 has changed from the OFF state to the ON state, determiner determines that ink cartridge 6 has been mounted to cartridge mounting portion 24 (S10: YES). Subsequently, at S11, estimator 63 starts to estimate the amount of ink stored in ink cartridge 6 based on the amount of ink consumed by inkjet head 3.

Subsequently, if determiner 62 determines that the state of optical sensor has changes from the ON state to the OFF state, i.e., the amount of ink stored in ink cartridge has become less than or equal to first threshold amount V1 (S12: YES), determiner 62 determines that ink cartridge 6 has become the low-amount state at S13. Subsequently, estimator 63 sets first predetermined amount Ve1 as an amount from which the amount of ink consumed by inkjet head 3 will be subtracted at S14. Subsequently, estimator 63 starts to estimate the amount of ink stored in ink cartridge 6 after the low-amount state is determined, by subtracting the amount of ink consumed by inkjet head 3 after the low-amount state is determined from first predetermined amount Ve1 at S15. Subsequently, if the estimated ink amount reaches some amount, e.g., zero (S16: NO), determiner 62 determines that ink cartridge 6 has become empty at S22.

On the other hand, if determiner 62 does not determine that the state of optical sensor has changed from the ON state to the OFF state (S12: NO), but determines that the ink amount estimated by estimator 63 has become less than or equal to second threshold amount V2 (S17: YES), determiner 62 determines that ink cartridge 6 has become the low-amount state at S18. Subsequently, estimator 63 sets second predetermined amount Ve2 as an amount from which the amount of ink consumed by inkjet head 3 will be subtracted at S19. Subsequently, estimator 63 starts to estimate the amount of ink stored in ink cartridge 6 after the low-amount state is determined, by subtracting the amount of ink consumed by inkjet head 3 after the low-amount state is determined from second predetermined amount Ve2 at S20. Subsequently, if the estimated ink amount reaches some amount, e.g., zero (S21: NO), determiner 62 determines that ink cartridge 6 has become empty at S22.

A structure of ink cartridge 6 for optical sensor 53 to detect the ink amount is not limited to sensor arm 31. In another embodiment, the structure may be a float made of light-blocking material. In another embodiment, ink itself may block light. In this case, ink cartridge 6 may not need a specific structure because optical sensor 53 may be able to detect the ink amount based on whether or not light is blocked by ink.

A detector for detecting the ink amount is not limited to optical sensor 53. In another embodiment, a proximity sensor or a contact sensor may be provided in cartridge mounting portion 24, and ink cartridge 6 may comprise a movable member connected to a float configured to move according to the ink amount stored in ink cartridge 6. The movable member may protrude from ink cartridge 6, and the proximity sensor or the contact sensor may detect a protruding portion of ink cartridge 6. In another embodiment, cartridge mounting portion 24 and ink cartridge 6 may comprise electric contacts, respectively, and the ink amount may be detected by measuring the electric resistance between the electric contacts.

In the above-described embodiment, optical sensor 53 is configured to detect whether or not the ink amount is greater than first threshold amount V1. In another embodiment, the ink amount may be detected in multi steps, or continuously with a plurality of sensors or a sensor with variable detection positions.

In the above-described embodiment, optical sensor 53 is used not only for detecting the ink amount, but also for detecting whether ink cartridge 6 has been mounted. In another embodiment, in addition to optical sensor 53, another sensor may be used only for detecting whether ink cartridge 6 has been mounted.

In the above-described embodiment, the present invention is applied to printer I configured to eject ink onto recording sheet P to record texts or images thereon. Nevertheless, the present invention is applicable to various liquid ejecting apparatus with a liquid ejecting head in various technical fields.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid ejecting apparatus comprising:

a liquid ejecting head configured to eject liquid;

a liquid container configured to store liquid therein, and configured to be in fluid communication with the liquid ejecting head;

a detector configured to detect an amount of liquid stored in the liquid container, wherein the detector is configured to be in a first state when the amount of liquid stored in the liquid container is greater than a first threshold amount, and to be in a second state when the amount of liquid stored in the liquid container is less than or equal to the first threshold amount;

an estimator configured to estimate the amount of liquid stored in the liquid container based on an amount of liquid consumed by the liquid ejecting head; and a determiner configured to determine:

(a) whether a state of the detector has changed from the first state to the second state;

(b) whether an amount of liquid estimated by the estimator has become less than or equal to a second threshold amount, which is less than the first threshold amount;

(c) that, if it is determined that the state of the detector has changed from the first state to the second state, the liquid container has become a low-amount state, in which the amount of liquid stored in the liquid container is low; and (d) that, if it is not determined that the state of the detector has changed from the first state to the second state, but it is determined that the amount of liquid estimated by the estimator has become less than or equal to the second threshold amount, the liquid container has become the low-amount state.

2. The liquid ejecting apparatus of claim 1, further comprising an error setter configured to set an estimation error which corresponds to a differential between the amount of liquid estimated by the estimator and an actual amount of liquid stored in the liquid container, wherein the determiner is configured to set the second threshold amount, such that the second threshold amount plus the estimation error becomes less than or equal to the first threshold amount.

3. The liquid ejecting apparatus of claim 1, wherein:

if the determiner determines that the liquid container has become the low-amount state based on a determination that the amount of liquid estimated by the estimator has become less than or equal to the second threshold amount, the estimator is configured to estimate the amount of liquid stored in the liquid container after the determiner determines that the liquid container has become the low-amount state, by subtracting the amount of liquid consumed by the liquid ejecting head after the determiner determines that the liquid container has become the low-amount state from a predetermined amount; and if the state of the detector changes from the first state to the second state after the determiner determines that the amount of liquid estimated by the estimator has become less than or equal to the second threshold amount, the estimator is configured not to reset the estimated amount of liquid stored in the liquid container after the determiner determines that the liquid container has become the low-amount state.

4. The liquid ejecting apparatus of claim 1, wherein:

if the determiner determines that the liquid container has become the low-amount state based on a determination that the state of the detector has changed from the first state to the second state, the estimator is configured to estimate the amount of liquid stored in the liquid container after the determiner determines that the liquid container has become the low-amount state, by subtracting the amount of liquid consumed by the liquid ejecting head after the determiner determines that the liquid container has become the low-amount state from a first predetermined amount;

if the determiner determines that the liquid container has become the low-amount state based on a determination that the amount of liquid estimated by the estimator has become less than or equal to the second threshold amount, the estimator is configured to estimate the amount of liquid stored in the liquid container after the determiner determines that the liquid container has become the low-amount state, by subtracting the amount of liquid consumed by the liquid ejecting head after the determiner determines that the liquid container has become the low-amount state from a second predetermined amount; and the second predetermined amount is less than the first predetermined amount.

5. The liquid ejecting apparatus of claim 1, wherein:

the detector comprises a light emitting portion configured to emit light toward the liquid container and a light receiving portion configured to receive light emitted from the light emitting portion and passing through the liquid container; and the liquid container comprises a float configured to move according to the amount of liquid stored in the liquid container and a light blocking portion connected to the float and configured to block the light emitted from the light emitting portion when the light blocking portion receives the light emitted from the light emitting portion.

* * * * *